US007798869B1

(12) United States Patent
Konopacki et al.

(10) Patent No.: US 7,798,869 B1
(45) Date of Patent: Sep. 21, 2010

(54) ELECTRICAL CONNECTOR

(75) Inventors: Jeffery M. Konopacki, Ripon, WI (US); Kevin R. Locke, Oshkosh, WI (US); Gregory D. Aykens, Neenah, WI (US)

(73) Assignee: Woodard Govenor Company, Fort Collins, CO (US)

( * ) Notice: Subject to any disclaimer, the term of this patent is extended or adjusted under 35 U.S.C. 154(b) by 171 days.

(21) Appl. No.: 12/136,097

(22) Filed: Jun. 10, 2008

(51) Int. Cl.
*H01R 4/36* (2006.01)

(52) U.S. Cl. ..... 439/812

(58) Field of Classification Search ..... 439/810–814
See application file for complete search history.

(56) References Cited

U.S. PATENT DOCUMENTS

| | | | | | |
|---|---|---|---|---|---|
| 2,774,953 | A | * | 12/1956 | Trier | 439/812 |
| 2,780,793 | A | * | 2/1957 | Gambale | 439/812 |
| 2,907,978 | A | * | 10/1959 | Bergan | 439/811 |
| 3,909,099 | A | | 9/1975 | Winkler | |
| 4,669,806 | A | * | 6/1987 | Fuchs | 439/712 |
| 4,749,370 | A | | 6/1988 | Moser et al. | |
| 5,021,006 | A | | 6/1991 | Fargeaud et al. | |
| 5,021,014 | A | * | 6/1991 | Walter et al. | 439/798 |
| 5,171,160 | A | * | 12/1992 | Beins et al. | 439/329 |
| 5,206,789 | A | * | 4/1993 | Barbry | 361/634 |
| 5,491,892 | A | | 2/1996 | Fritz et al. | |
| 5,664,971 | A | * | 9/1997 | Coy | 439/811 |
| 5,866,844 | A | | 2/1999 | Osterbrock et al. | |
| 6,293,812 | B1 | | 9/2001 | Ewer et al. | |
| 6,743,029 | B1 | | 6/2004 | Greene et al. | |
| 6,939,149 | B2 | | 9/2005 | Goodsell et al. | |
| 7,033,231 | B2 | * | 4/2006 | Lu | 439/812 |
| 7,134,922 | B2 | | 11/2006 | Kim | |
| 7,404,745 | B1 | * | 7/2008 | Wu | 439/811 |
| 7,540,792 | B2 | * | 6/2009 | Ananthakrishnan et al. | 439/811 |
| 2002/0081914 | A1 | * | 6/2002 | Takaya et al. | 439/810 |
| 2008/0102714 | A1 | * | 5/2008 | Weber et al. | 439/813 |

* cited by examiner

*Primary Examiner*—Gary F. Paumen
(74) *Attorney, Agent, or Firm*—Reinhart Boerner Van Deuren P.C.

(57) ABSTRACT

A connector combines a clamp member, an insert, and a conductor to provide a robust connection between a wire and an electrically conductive component. A set screw is used to provide a force in a clamping direction through the insert member and a segment of the conductor which is disposed in electrical communication and physical contact with an internal conductive portion of a wire.

20 Claims, 2 Drawing Sheets

ELECTRICAL CONNECTOR

BACKGROUND OF THE INVENTION

1. Field of the Invention

The present invention is generally related to an electrical connector and, more particularly, to an electrical connector with clamping surfaces which are shaped to engage an electrical wire and exert a clamping force through the use of a forcing member, such as a screw, which captures a conductor between the wire and another clamping surface.

2. Description of the Related Art

Those skilled in the art of electrical connectors are familiar with many different types of clamping arrangements that are intended to physically attach two electrical conductors together while providing an efficient electrical connection is between components.

U.S. Pat. No. 3,909,099, which issued to Winkler, on Sep. 30, 1975, describes an electrical connector with movably mounted hose clamp. The connector has a cable clamp which is movably secured with respect to the connector. The cable clamp is free to pivotally move in a plane containing longitudinal axes of the cable and the terminal portion of the electrical connector, but is restrained from movement in a direction along the longitudinal axis thereof.

U.S. Pat. No. 4,749,370, which issued to Moser et al. on Jun. 7, 1988, describes a cable clamp for an electrical connector. First and second clamping walls are moved into overlapping relation to deform transversely and trap between them a portion of the cable to be terminated. Cam means urge overlapping portions of the walls together into gripping engagement with the trapped cable portion and cable gripping means ensure that cable is only drawn from one direction during clamping to avoid straining the termination.

U.S. Pat. No. 5,021,006, which issued to Fargeaud et al. on Jun. 4, 1991, describes a cable clamp for an electrical connector. A strain relief clamp for securely engaging a multiconductor cable between two relatively moveable pieces at a position closely adjacent the connections of the conductors to the terminals of an electrical plug, receptacle, or other wiring device is described. A first piece includes a hollow, cylindrical shell having an integrally formed, generally semi-cylindrical portion internally of the shell at one end, the wiring device is secured in the other end. A second piece is positioned inside the shell with an arcuate surface opposing an inwardly facing, curved surface of the semi-cylindrical portion of the first piece.

U.S. Pat. No. 5,491,892, which issued to Fritz et al. on Feb. 20, 1996, describes a method and apparatus of mounting a package housing and is ground strap. A ground strap and vibration mount assembly effectively mechanically isolates an electronic component from vibration while also providing an electrically conductive path to ground potential. The assembly includes a vibration dampener mounted through an opening formed in a tab projecting from the housing of the vibration sensitive electronic component. An insert is provided therein and a mounting bolt is positioned through a suitable opening formed through the insert. An electrically conductive ground strap is wrapped partially around the tab. An aperture is formed in one portion of the strap and the bolt is passed therethrough. Opposing ends of the electrically conductive connector are secured to the tab.

U.S. Pat. No. 5,866,844, which issued to Osterbrock et al. on Feb. 2, 1999, describes a wiring device with a ground clamping plate. The device includes a pressure plate which engages the ground plate of a receptacle with legs of a pressure plate disposed within correspondingly shaped recesses adjacent the ground plate of the receptacle, so that the pressure plate is substantially constrained from rotation relative to the ground plate so that a wire can be received between the ground plate and the pressure plate when the screw is backed out a sufficient distance.

U.S. Pat. No. 6,293,812, which issued to Ewer et al. on Sep. 25, 2001, describes an electrical connector contact bridge with a wire clamp. It includes a bridge strap with a base plate and an abutment member coupled to and extending from the bridge strap. The base plate extends substantially perpendicular to the bridge strap and has an internally threaded bore. An abutment member extends adjacent a side edge of the base plate, and has a planar surface extending perpendicularly to and facing the base plate. A clamping plate overlies the base plate, has a substantially straight side edge adjacent the planar surface and has a through bore. A screw extends through the bore in the clamping plate and threadedly engages the threaded bore to the base plate.

U.S. Pat. No. 6,743,029, which issued to Greene et al. on Jun. 1, 2004, describes a back wire ground clamp. A ground lug is coupled to a clamp plate by means of a screw which passes through a clearance opening in the clamp plate and is threaded into a receiving opening in the ground lug. The clamp plate supports a blocking tab which extends downward below the front edge of the ground lug and it extends sideways for a distance which is less than the length of the front edge of the ground lug.

U.S. Pat. No. 6,939,149, which issued to Goodsell et al. on Sep. 6, 2005, describes an electrical device with a mechanism to prevent separation of the electrical receptacle housing. The receptacle, which includes a first housing portion and a second housing portion coupled to the first housing portion is described. An electrical device is positioned between the first and second housing portions. The terminal has a base and a first protrusion and a second protrusion extending transverse to the base. The first and second protrusions are on opposite sides of the terminal. A clamp is located adjacent to the terminal and positioned between the first and second protrusions and is adapted to couple an electrical wire to the terminal. A fastening device extends through the clamp and is adapted to rotate relative to the terminal. When rotated, the clamp engages at least one of the first and second protrusions on the terminal to limit rotation of the clamp relative to the terminal, thereby preventing separation of the housing.

U.S. Pat. No. 7,134,922, which issued to Kim on Nov. 14, 2006, describes a wire connecting apparatus for a magnetic contactor. It comprises a plurality of wire connector assemblies, a frame for supporting the wire connector assemblies, and a plurality of terminals connected to an external wire. The external wire can be simply connected to the terminal by just tightening or releasing a screw, thereby simplifying an entire wiring process and enhancing work efficiency.

The patents described above are hereby expressly incorporated by reference in the description of the present invention.

Typical connection terminals for large diameter electrical wires can be inefficient in electrical current transfer and can possibly damage stripped wire ends when the wire is secured using a set screw. As described above, a number of styles of existing electrical wire lugs are commercially available and well known to those skilled in the art. It would be significantly beneficial if a connector could be provided which provides secure capturing of a wire end by securing the wires between clamping surfaces to avoid possible damage from direct contact between the wire and a rotatable set screw or other fastening device. In addition, it would be beneficial if the electrical conductivity of the clamping device were improved to increase its efficiency and reducing potential high resistance connections.

SUMMARY OF THE INVENTION

An electrical connector made in accordance with a preferred embodiment of the present invention comprises the clamp member having a first clamping surface disposed within an opening of its structure, an insert member shaped to be received within the opening, a conductor having a third clamping surface, and a forcing member configured to exert a force on the insert member in a direction toward a wire. The insert member has a second clamping surface and the first and third clamping surfaces are shaped to receive the wire therebetween. The second clamping surface is shaped to transmit the force, from the forcing member, against the third clamping surface in a direction toward the wire.

In a preferred embodiment of the present invention, the forcing member is a screw which is engageable with a threaded hole formed in the clamp member, wherein threading the screw inwardly toward the wire increases the clamping force on the wire by the first and third clamping surfaces. The insert member comprises a hole into which a distal end of the screw is received. The hole is formed in a surface of the insert member which is opposite from the second clamping surface. The screw extends through the threaded hole formed in the clamp member and into the hole of the insert member. Also in a preferred embodiment of the present invention, the first clamping surface of the opening has a concave arcuate portion shaped to receive an outer surface of the wire and the conductor comprises a segment on which the third clamping surface is formed and which is shaped to be disposed between the insert member and the wire. The conductor comprises an extension portion which extends from the segment. The extension portion is connectable in electrical communication with an electrically conductive component to provide a conductive path between the electrically conductive component and the wire.

In a preferred embodiment of the present invention, the opening within the clamp member is generally rectangular in cross-section with one of its internal surfaces being the first clamping surface. The wire is generally circular in cross-section in a preferred embodiment of the present invention and the first and third clamping surfaces are generally arcuate. In one embodiment of the present invention, it further comprises a retainer shaped to receive the clamp member wherein an outer surface of the clamp member is generally rectangular in cross-section and shaped to be received in a holding compartment of the retainer. The retainer is attachable to a stationary object.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
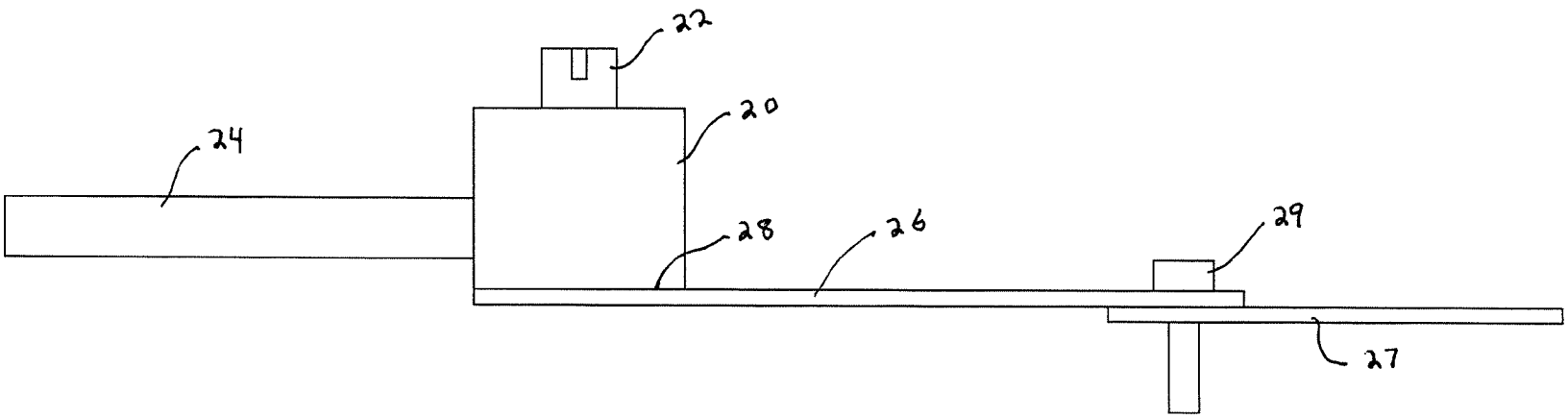
FIG. 2 shows a known type of electrical connector.

Throughout the description of the preferred embodiment of the present invention, like components will be identified by like reference numerals.

Figure 1:
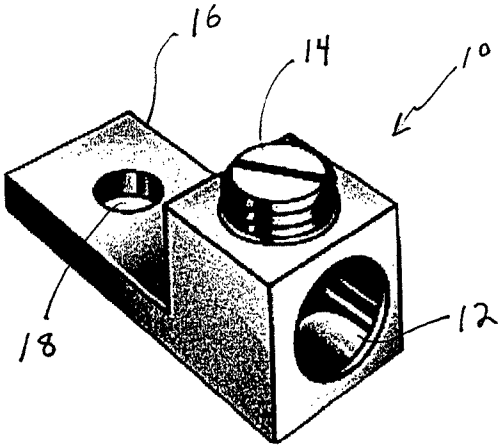
FIG. 1 shows a known type of connector clamp which is known as a wire lug.

FIGS. 1 and 2 show known types of connectors which are used to clamp a wire to an electrically conductive component. FIG. 1 is a simple wire lug 10 that provides a hole 12 into which a wire can be inserted. A set screw 14 can be threaded downwardly into the hole 12 and against the wire in order to clamp the wire in place within the hole. The connector is provided with an extension 16 which has a hole 18 that allows it to be rigidly attached to an electrically conductive component.

FIG. 2 shows another connector that is known to those skilled in the art. A lug portion 20 is provided with a set screw 22 that allows a wire 24 to be rigidly held in place within a hole extending through the lug 20 in the manner described below in conjunction with FIG. 1. A bus bar 26 is soldered to a surface 28 of the is lug 20. A hole in the bus bar 26 allows a screw 29 to attach the bus bar 26 to an electrical conductor 27.

In order to understand the benefits of the present invention, which will be described in detail below, it is helpful to understand some of the disadvantages of connection systems that are known to those skilled in the art. With particular reference to FIG. 2, an electric current flowing between the wire 24 and the electrical conductor 27 must pass through several points of potential resistance that are created by the connector itself. As an example, between the wire 24 and the internal cylindrical hole through the lug 20, a contact surface interface exists. The resistance of that interface is partially controlled by the force provided by the set screw 22 and the relative conformity between the outer surface of the wire 24 and the inner surface of the cylindrical hole passing through the lug 20. In addition, another potentially resistive interface is created at the surface 28 which typically is a solder connection. Furthermore, the contact surface between the bus bar 26 and the component 27 provides additional resistance which depends on the conformity of the two surfaces in contact and the force provided by the screw 29.

Figure 3:
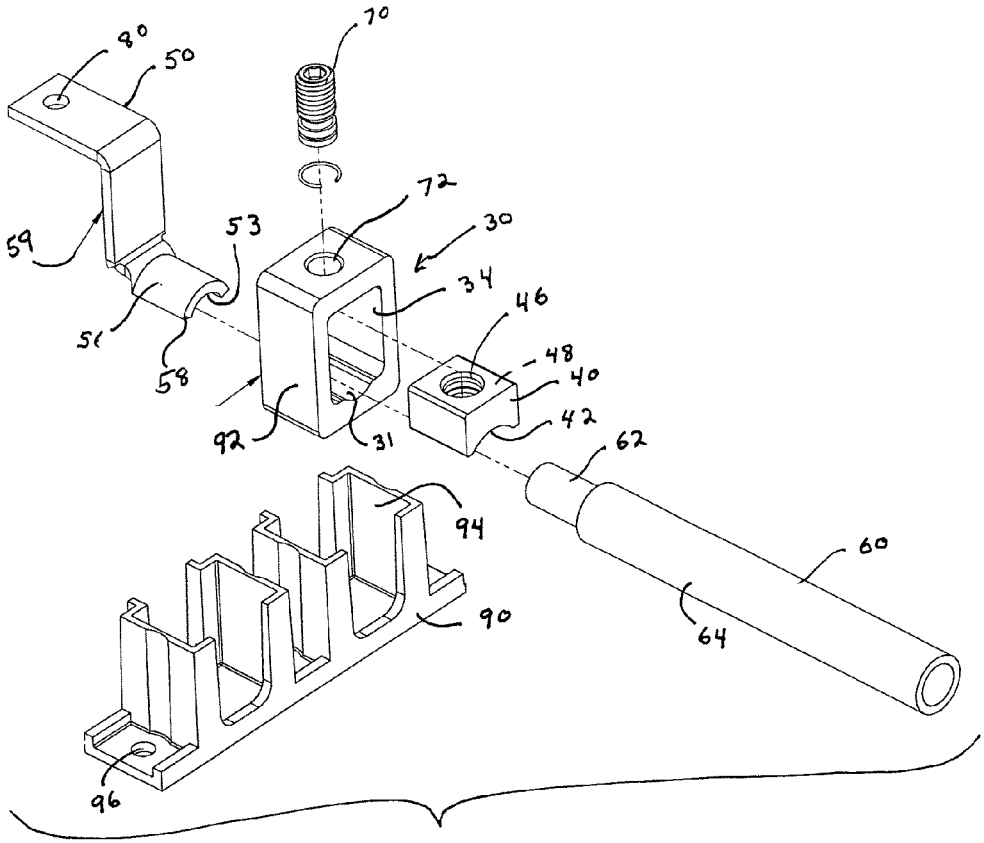
FIG. 3 is an exploded isometric view of a preferred embodiment of the present invention.

FIG. 3 shows a preferred embodiment of the present invention. It comprises a clamp member 30 which has a first clamping surface 31 disposed within an opening 34 in its structure. An insert member 40 is shaped to be received within the opening 34. The insert member 40 has a second clamping surface 42. A conductor 50, which is generally analogous to the bus bar 26 described above, has a third clamping surface 53. The first and third clamping surfaces, 31 and 53, are shaped to receive a wire 60 therebetween. In FIG. 3, the wire 60 is shown having an internal conductor 62 covered by an insulative coating 64. The insulative coating 64 is stripped away at the end of the wire 60 to allow electrical contact between it and the first and third clamping surfaces, 31 and 53. A forcing member 70, which is a set screw in a preferred embodiment of the present invention, is configured to exert a force on the insert member 40.

The conductor 50 is provided with a segment 58 on which the first clamping surface 53 is formed and which is shaped to be disposed between the insert member 40 and the conductive portion 62 of the wire 60. The conductor 50 comprises an extension portion 59 which extends from the segment 58. The extension portion 59 is connectable in electrical communication with an electrically conductive component, such as that which is described above in conjunction with FIG. 2 and identified by reference numeral 27, to provide a conductive path between the electrically conductive component and the wire 60. The opening 34 within the clamp member 30 is generally rectangular in cross-sectional shape with one of its internal surfaces being the first clamping surface 31. The wire 60 is generally circular in cross-section in a preferred embodiment of the present invention and the first and third clamping surfaces, 31 and 53, are also generally arcuate and shaped to provide good electrical contact between them and the wire. The insert member 40 is provided with a hole 46, or depression, that is shaped to receive the distal end of the forcing member 70 to assist in transmitting the force of the forcing member 70 in a direction through the insert member 40 and against the conductive portion 62 of the wire.

With continued reference to FIG. 3, the hole 46 connects the forcing member 70, or stud, to the insert member 40 in a manner that allows rotation of the forcing member to cause the insert member to move up or down in response to that rotation. This rotatable attachment between the forcing member 70 and the insert member 40 is assisted by the partial ring, or screw clip, shown directly below the forcing member in FIG. 3. As a result, the counterclockwise rotation of the forcing member 70 lifts the insert member 40 away from the conductive portion 62 of the wire 60 wire and retains the insert member 40 in contact with the forcing member 70 during both tightening and loosening procedures.

Figure 4:
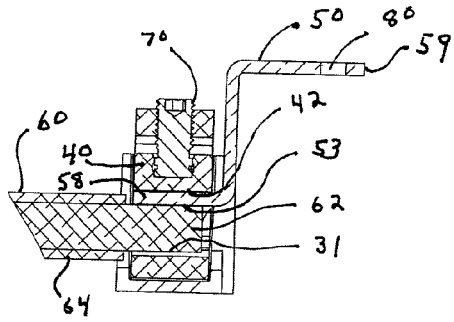
FIG. 4 is a sectional view of an assembled connector made in accordance with a preferred embodiment of the present invention.

FIG. 4 is a section view of an assembled connector made in accordance with a preferred embodiment of the present invention. The wire 60 is shown with its end portion 62 extending from the insulative sheath. This is done to expose the internal conductor 62. In FIG. 4, it can be seen that the conductive portion 62 of the wire 60 is clamped between the first and third clamping surfaces, 31 and 53, and the second clamping surface 42 exerts a force on the segment 58 of the conductor 50 to facilitate this clamping action and to enhance the electrical conductivity between the contacting surfaces. A hole 80 is provided to facilitate the attachment of the conductor 50 to another component.

Figure 5:
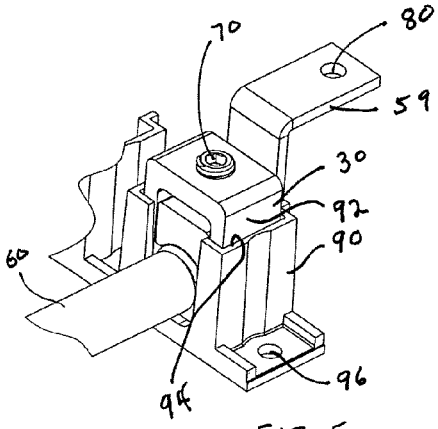
FIG. 5 shows a retainer which is usable in conjunction with a preferred embodiment of the present invention.

In certain embodiments of the present invention, it further comprises, as illustrated in FIG. 5, a retainer 90 that is shaped to receive the clamp member 30 therein. An outer surface 92 of the clamp member 30 is generally rectangular in cross-sectional area and is shaped to be received in a holding compartment 94 of the retainer 90. The retainer 90 is attachable to a stationary object. As an example, holes 96 are provided to facilitate this attachment. The retainer 90 is illustrated in FIGS. 3 and 5 and, as shown, can be shaped to receive a plurality of clamp members 30.

With continued reference to FIGS. 3-5, it can be seen that an electrical connector made in accordance with a preferred embodiment of the present invention comprises a clamp member 30 having a first clamping surface 31 disposed within an opening 34 in its structure, an insert member 40 shaped to be received within the opening 34 and having a second clamping surface 42, a conductor 50 having a third clamping surface 53, wherein the first and third clamping surfaces, 31 and 53, are shaped to receive a wire 60 therebetween, and a forcing member 70 configured to exert a force on the insert member 40 in a direction toward the wire 60 with the second clamping surface 42 being shaped to transmit the force on the third clamping surface 53 in a direction toward the wire 60 and, more particularly, toward a conductive internal portion 62 of the wire.

Although the present invention has been described with particular specificity and illustrated to show a preferred embodiment, it should be understood that alternative embodiments are also within its scope.

We claim:

1. An electrical connector, comprising:

a clamp member having a first clamping surface disposed within an opening in its structure;

an insert member shaped to be received within said opening, said insert member having a second clamping surface;

a conductor having a third clamping surface, said first and third clamping surfaces being shaped to receive a wire therebetween; and a forcing member configured to exert a force on said insert member in a direction toward said wire, said second clamping surface being shaped to transmit said force on said third clamping surface in a direction toward said wire.

2. The electrical connector of claim 1, wherein:

said forcing member is a screw which is engageable with a threaded hole formed in said clamp member, wherein threading said screw inwardly toward said wire increases the clamping force on said wire by said first and third clamping surfaces.

3. The electrical connector of claim 2, wherein:

said insert member comprises a hole into which a distal end of said screw is received, said hole being formed in a surface of said insert member which is opposite from said second clamping surface, said screw extending through said threaded hole formed in said clamp member and into said hole of said insert member.

4. The electrical connector of claim 1, wherein:

said first clamping surface of said opening has a concave arcuate portion shaped to receive an outer surface of said wire.

5. The electrical connector of claim 1, wherein:

said conductor comprises a segment on which said third clamping surface is formed and which is shaped to be disposed between said insert member and said wire.

6. The electrical connector of claim 1, wherein:

said conductor comprises an extension portion which extends from said segment, said extension portion being connectable in electrical communication with an electrically conductive component to provide a conductive path between said electrically conductive component and said wire.

7. The electrical connector of claim 1, wherein:

said opening within said clamp member is generally rectangular in cross section with one of its internal surfaces being said first clamping surface.

8. The electrical connector of claim 1, wherein:

said wire is generally circular in cross section, said first and third clamping surfaces being generally arcuate.

9. The electrical connector of claim 1, further comprising:

a retainer shaped to receive said clamp member therein.

10. The electrical connector of claim 8, wherein:

an outer surface of said clamp member is generally rectangular in cross section and shaped to be received in a holding compartment of said retainer, said retainer being attachable to a stationary object.

11. An electrical connector, comprising:

a clamp member having a first clamping surface disposed within an opening in its structure;

an insert member shaped to be received within said opening, said insert member having a second clamping surface;

a conductor having a third clamping surface, said first and third clamping surfaces being shaped to receive a wire therebetween, said conductor comprising a segment on which said third clamping surface is formed and which is shaped to be disposed between said insert member and said wire; and a forcing member configured to exert a force on said insert member in a direction toward said wire, said second clamping surface being shaped to transmit said force on said third clamping surface in a direction toward said wire, said conductor comprises an extension portion which extends from said segment, said extension portion being connectable in electrical communication with an electrically conductive component to provide a conductive path between said electrically conductive component and said wire.

12. The electrical connector of claim 11, wherein:

said forcing member is a screw which is engageable with a threaded hole formed in said clamp member, wherein threading said screw inwardly toward said wire increases the clamping force on said wire by said first and third clamping surfaces, said insert member comprising a hole into which a distal end of said screw is received, said hole being formed in a surface of said insert member which is opposite from said second clamping surface, said screw extending through said threaded hole formed in said clamp member and into said hole of said insert member to rotatably attach said screw to said insert member.

13. The electrical connector of claim 11, wherein:

said first clamping surface of said opening has a concave arcuate portion shaped to receive an outer surface of said wire.

14. The electrical connector of claim 11, wherein:

said opening within said clamp member is generally rectangular in cross section with one of its internal surfaces being said first clamping surface.

15. The electrical connector of claim 11, wherein:

said wire is generally circular in cross section, said first and third clamping surfaces being generally arcuate.

16. The electrical connector of claim 11, further comprising:

a retainer shaped to receive said clamp member therein.

17. The electrical connector of claim 16, wherein:

an outer surface of said clamp member is generally rectangular in cross section and shaped to be received in a holding compartment of said retainer, said retainer being attachable to a stationary object.

18. An electrical connector, comprising:

a clamp member having a first clamping surface disposed within an opening in its structure;

an insert member shaped to be received within said opening, said insert member having a second clamping surface;

a conductor having a third clamping surface, said first and third clamping surfaces being shaped to receive a wire therebetween; and a forcing member configured to exert a force on said insert member in a direction toward said wire, said second clamping surface being shaped to transmit said force on said third clamping surface in a direction toward said wire, said first clamping surface of said opening having a concave arcuate portion shaped to receive an outer surface of said wire, said forcing member being a screw which is engageable with a threaded hole formed in said clamp member, wherein threading said screw inwardly toward said wire increases the clamping force on said wire by said first and third clamping surfaces, said insert member comprising a hole into which a distal end of said screw is received, said hole being formed in a surface of said insert member which is opposite from said second clamping surface, said screw extending through said threaded hole formed in said clamp member and into said hole of said insert member to rotatably attach said screw to said insert member, said conductor comprising a segment on which said third clamping surface is formed and which is shaped to be disposed between said insert member and said wire.

19. The electrical connector of claim 18, wherein:

said conductor comprises an extension portion which extends from said segment, said extension portion being connectable in electrical communication with an electrically conductive component to provide a conductive path between said electrically conductive component and said wire, said opening within said clamp member being generally rectangular in cross section with one of its internal surfaces being said first clamping surface, said wire being generally circular in cross section, said first and third clamping surfaces being generally arcuate.

20. The electrical connector of claim 18, further comprising:

a retainer shaped to receive said clamp member therein, an outer surface of said clamp member being generally rectangular in cross section and shaped to be received in a holding compartment of said retainer, said retainer being attachable to a stationary object.

* * * * *